US008105017B2

(12) United States Patent
Dorsch et al.

(10) Patent No.: US 8,105,017 B2
(45) Date of Patent: Jan. 31, 2012

(54) CENTRIFUGAL CHOPPER PUMP WITH IMPELLER ASSEMBLY

(75) Inventors: Glenn Robert Dorsch, Aberdeen, WA (US); Kent Harrison Keeran, Elma, WA (US)

(73) Assignee: Vaughan Co., Inc., Montesano, WA (US)

( * ) Notice: Subject to any disclaimer, the term of this patent is extended or adjusted under 35 U.S.C. 154(b) by 839 days.

(21) Appl. No.: 12/220,829

(22) Filed: Jul. 29, 2008

(65) Prior Publication Data

US 2010/0028136 A1 Feb. 4, 2010

(51) Int. Cl.

| | |
|---|---|
| ***F01D 25/00*** | (2006.01) |
| ***F03D 11/00*** | (2006.01) |
| ***F03D 11/02*** | (2006.01) |
| ***F04B 23/14*** | (2006.01) |
| ***F04D 29/38*** | (2006.01) |

(52) U.S. Cl. ..... 415/121.1; 416/186 R; 416/185; 416/203; 416/223 B

(58) Field of Classification Search ..... 416/185, 416/203, 223 B, 186 R, 192, 1; 415/121.1, 415/208.2

See application file for complete search history.

(56) References Cited

U.S. PATENT DOCUMENTS

| | | | | |
|---|---|---|---|---|
| 2,714,354 | A | 8/1955 | Farrand | |
| 3,155,046 | A | 11/1964 | Vaughan | |
| 3,325,107 | A | 6/1967 | Peterson | |
| 3,340,812 | A | 9/1967 | Schlesiger | |
| 3,444,818 | A | 5/1969 | Sutton | |
| 3,973,866 | A | 8/1976 | Vaughan | |
| 4,527,947 | A | 7/1985 | Elliott | |
| 4,575,308 | A | 3/1986 | Corkill | |
| 4,842,479 | A | 6/1989 | Dorsch | |
| 5,076,757 | A | 12/1991 | Dorsch | |
| 5,256,032 | A | 10/1993 | Dorsch | |
| 5,456,580 | A | 10/1995 | Dorsch | |
| 5,460,482 | A | 10/1995 | Dorsch | |
| 5,460,483 | A | 10/1995 | Dorsch | |
| 7,125,221 | B2 * | 10/2006 | Dorsch et al. | 415/121.1 |
| 7,159,806 | B1 * | 1/2007 | Ritsema | 241/46.06 |
| 7,811,051 | B2 * | 10/2010 | Wagner | 415/121.1 |
| 7,823,807 | B1 * | 11/2010 | Bauer | 239/688 |

FOREIGN PATENT DOCUMENTS

| | | |
|---|---|---|
| CA | 729917 | 3/1966 |
| FR | 1323707 | 3/1962 |
| GB | 1551918 | 9/1979 |

* cited by examiner

*Primary Examiner* — Chuong A. Luu
(74) *Attorney, Agent, or Firm* — Bishop & Diehl, Ltd.

(57) ABSTRACT

The disclosed solid waste pump is a chopper pump, and preferably a chopper pump having a small rated motor and a semi-open impeller design. Particularly, a chopper pump having an impeller, at least one pump-out vane, an end plate, and a back plate including at least one cutting rib is disclosed. The impeller includes a back shroud and cutting vanes sharpened on a first edge extending opposite the back shroud and fixed on a first surface of the back shroud. The at least one pump-out vane is preferably fixed to a second surface of the back shroud opposite the first surface, while the end plate includes a surface adjacent to and facing the first edge of the cutting vanes and at least one internal cutting rib fixed to the end plate surface for shearing operation in combination with the sharpened edge of the cutting vanes of the impeller. Finally, the back plate has a surface adjacent to and facing the at least one pump-out vane and at least one cutting rib attached to the back plate surface for shearing operation in combination with the at least one pump-out vane.

32 Claims, 14 Drawing Sheets

CENTRIFUGAL CHOPPER PUMP WITH IMPELLER ASSEMBLY

TECHNICAL FIELD OF THE INVENTION

The present device relates to a centrifugal pump effective for pumping liquids and slurries containing solid matter, including various types of refuse, and for chopping the solid matter which may thereafter be processed for disposal. Particularly, the device relates to a chopper pump which both effectively allows the pump to continue working during heavy chopping and efficiently reduces wear on components due to the presence of grit-like material in the liquid.

BACKGROUND OF THE INVENTION

Generally speaking, U.S. Pat. No. 3,155,046 to Vaughan, issued Nov. 3, 1964, discloses a centrifugal pump having an open impeller with radial vanes. The vane edges adjacent to the pump inlet cooperate with sharpened edges of inlet apertures to cut stringy material or chunks entering the pump. Similarly, U.S. Pat. No. 3,973,866 to Vaughan, issued Aug. 10, 1976, and U.S. Pat. No. 4,842,479 to Dorsch, issued Jun. 27, 1989, disclose centrifugal pumps having impellers with vanes cooperating with inlet apertures to achieve a chopping or slicing action of solid material in a liquid or slurry being pumped. In the case of the pumps of U.S. Pat. No. 3,973,866 to Vaughan and U.S. Pat. No. 4,842,479 to Dorsch, however, semi-open impellers having radial shroud plates are used and external booster propellers may be provided to accelerate flow into the pump. The latter, when used, helps displace chunks of solid matter which become lodged in the inlet apertures and, at least in some instances, cuts solid matter prior to entry into the pump.

Other types of pumps having external cutters rotated with an impeller or propeller are shown in U.S. Pat. No. 2,714,354 to Farrand, issued Aug. 2, 1955; U.S. Pat. No. 3,325,107 to Peterson, issued Jun. 13, 1967; and French Patent No. 1.323.707, issued Mar. 1, 1962. U.S. Pat. No. 3,444,818 to Sutton, issued May 20, 1969, discloses another type of centrifugal pump having an internal impeller with vanes cooperating with the periphery of an inlet aperture to achieve a slicing action. In the Sutton construction, an outer "chopper member" has blades that wipe across the outer surface of the apertured intake plate to assist in chopping solid material to a size small enough to enter the intake aperture. Similarly, in the construction shown in British Patent No. 1,551,918, published Sep. 5, 1979, external blades sweep across small intake apertures to dislodge or gradually cut solid material clogging an intake aperture. In both the construction shown in the Sutton patent and the construction shown in the British patent, the external member is mounted so as to be moveable axially away from the intake plate if a hard obstruction is encountered.

Other types of pumps designed for pumping liquids or slurries containing solid materials are disclosed in Canadian Patent No. 729,917, issued Mar. 15, 1966; Schlesiger U.S. Pat. No. 3,340,812, issued Sep. 12, 1967; Elliott U.S. Pat. No. 4,527,947, issued Jul. 9, 1985; and Corkill U.S. Pat. No. 4,575,308, issued Mar. 11, 1986.

One of the problems with each of these devices is the occurrence of motor overloading during heavy chopping. Where the chopping is not efficient, the motor power increases causing the motor protection controls to trip the motor offline. When the motor goes offline, the chopping stops and operator intervention is required to place the motor back online. The chopping down-time, of course, detracts from the cost effectiveness of the process.

Another problem relates to excessive wear on the cutting parts over time. Fibrous material, such as hair and the like, tend to accumulate in the cutting area, particularly at the cutting parts. The fibrous material collects grit and sand causing the cutting parts to grind down prematurely. A cutter nut and cutter bar assembly at the pump intake has been used to keep the cutting parts clear of such fiber and debris.

Perhaps the most closely related device for this purpose is shown in U.S. Pat. No. 5,460,483 to Dorsch, issued Oct. 24, 1995. The Dorsch '483 patent illustrates a square cutter nut projection (60) in FIG. 12. FIG. 15 of Dorsch '483 better illustrates the cutting operation of the projection (60) as it passes fingers (41). However, such a configuration is not nearly as aggressive as the invention of the present disclosure.

It is therefore desirable to provide a cutter assembly which helps maintain a clear cutting area, reduces cutting part wear and improves chopping efficiency to reduce motor power load and chopping down-time. It also would be desirable to provide a cutter assembly which aggressively reduces the build-up and collection of grit in the cutting area. The disclosed device affords other structural, manufacture and operating efficiencies not seen in prior art devices, as well

SUMMARY OF THE INVENTION

There is disclosed herein an improved solid waste pump design which avoids the disadvantages of prior devices while affording additional structural and operating advantages.

The disclosed solid waste pump is preferably a chopper pump, and more preferably a chopper pump having a semi-open impeller design. Particularly, a chopper pump comprising an impeller, at least one pump-out vane, an end plate, and a back plate including at least one back cutting rib is disclosed. The cutting rib is preferably raised above the surface of the back plate. The back plate surface adjacent to and facing the at least one pump-out vane includes the at least one back cutting rib, and the raised rib operates in combination with the at least one pump-out vane for a shearing action. The cutting rib is preferably in the form of a replaceable insert to allow replacement of the back cutting rib when it becomes worn.

In another embodiment, the impeller includes a back shroud and cutting blades sharpened on a first edge extending opposite the back shroud and fixed on a first surface of the back shroud. The at least one pump-out vane is preferably fixed to a second surface of the back shroud opposite the first surface, while the end plate includes a surface adjacent to and facing the first edge of the cutting blades. The end plate may include one or more stationary shear fingers at the pump intake opening and may also include one or more internal cutting grooves cut into the end plate surface for a shearing operation in combination with the sharpened edge of the cutting blades of the impeller. The two shearing operations are capable of working together to efficiently reduce solid material within the pump.

These and other aspects of the invention may be understood more readily from the following description and the appended drawings.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

DETAILED DESCRIPTION OF PREFERRED EMBODIMENTS

Figure 1:
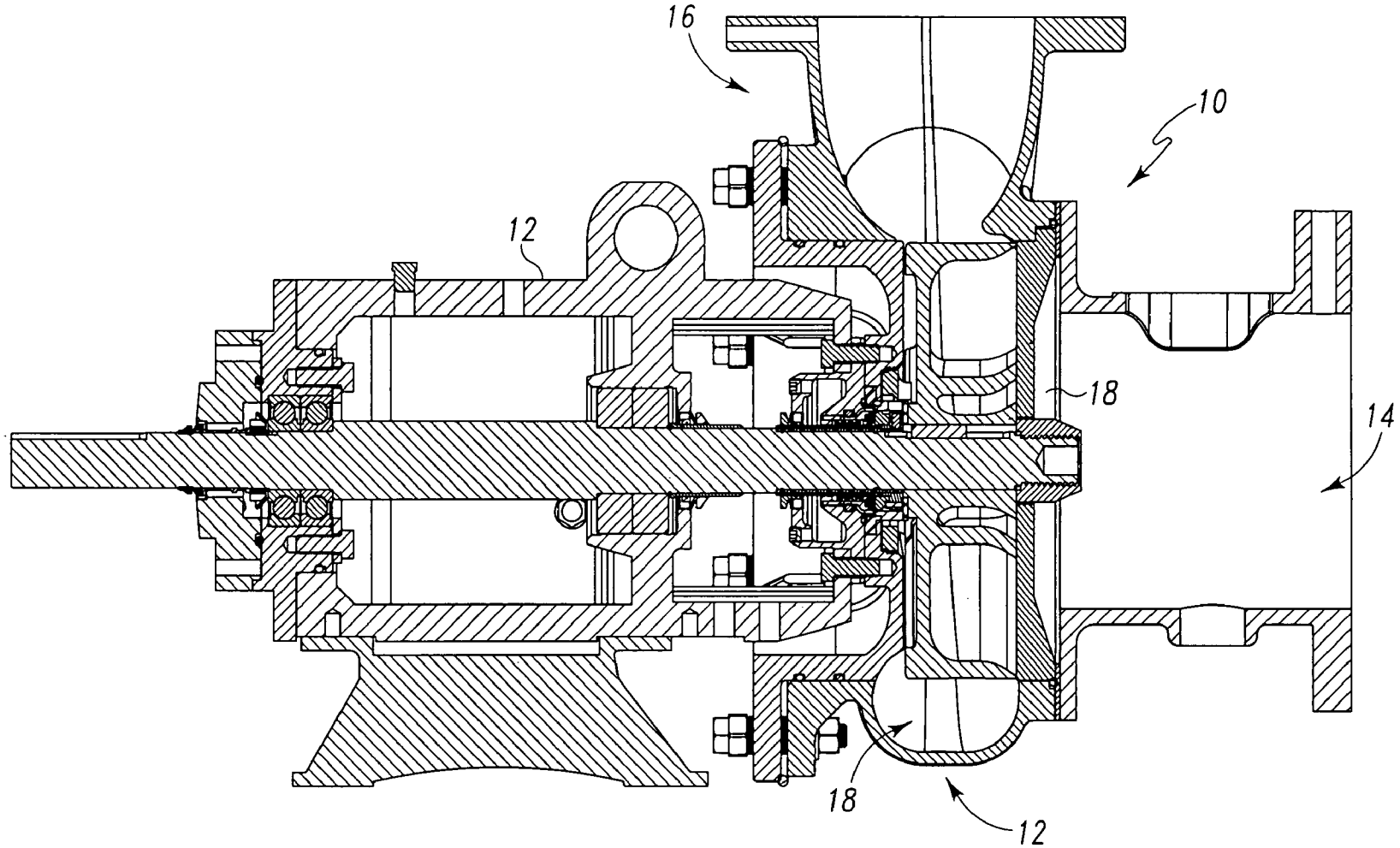
FIG. 1 is a side elevation of an installation of a centrifugal chopper pump in accordance with an embodiment of the present invention.

While this invention is susceptible of embodiments in many different forms, there is shown in the drawings and will herein be described in detail a preferred embodiment of the invention with the understanding that the present disclosure is to be considered as an exemplification of the principles of the invention and is not intended to limit the broad aspect of the invention to embodiments illustrated.

Referring to FIGS. 1-15, there is illustrated a chopper pump, generally designated by the numeral 10. The chopper pump 10 has a housing 12 having an intake opening 14 and an outlet opening 16, both in fluid communication with an internal chamber 18. A similar chopper pump is illustrated and disclosed in U.S. Pat. No. 5,460,482 to Dorsch, the patent being assigned to the Assignee of the present invention. To the extent an understanding of the construction and operation of the present invention is aided by the '482 patent, the same is hereby incorporated by reference.

Figure 2:
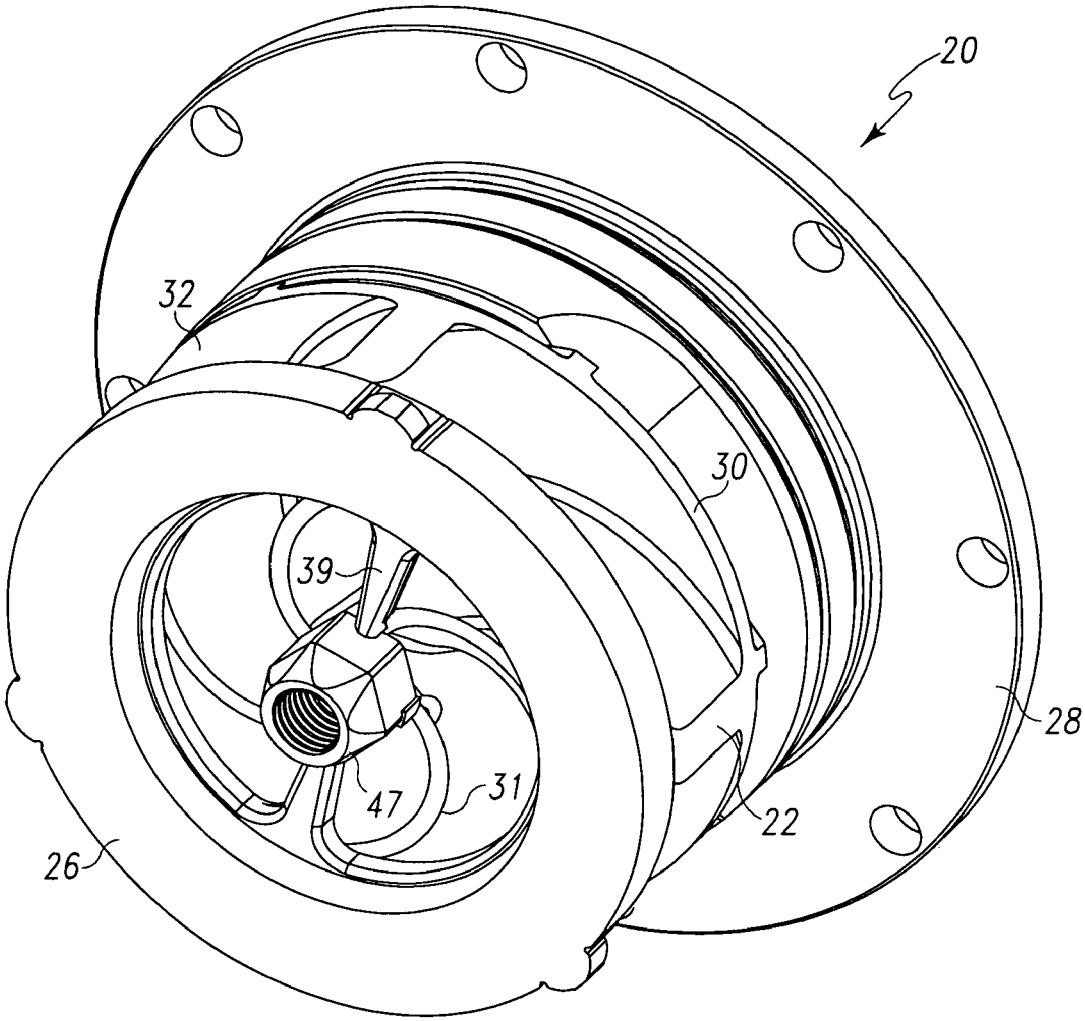
FIG. 2 is a perspective view of an impeller assembly in accordance with an embodiment of the present invention.
Figure 3:
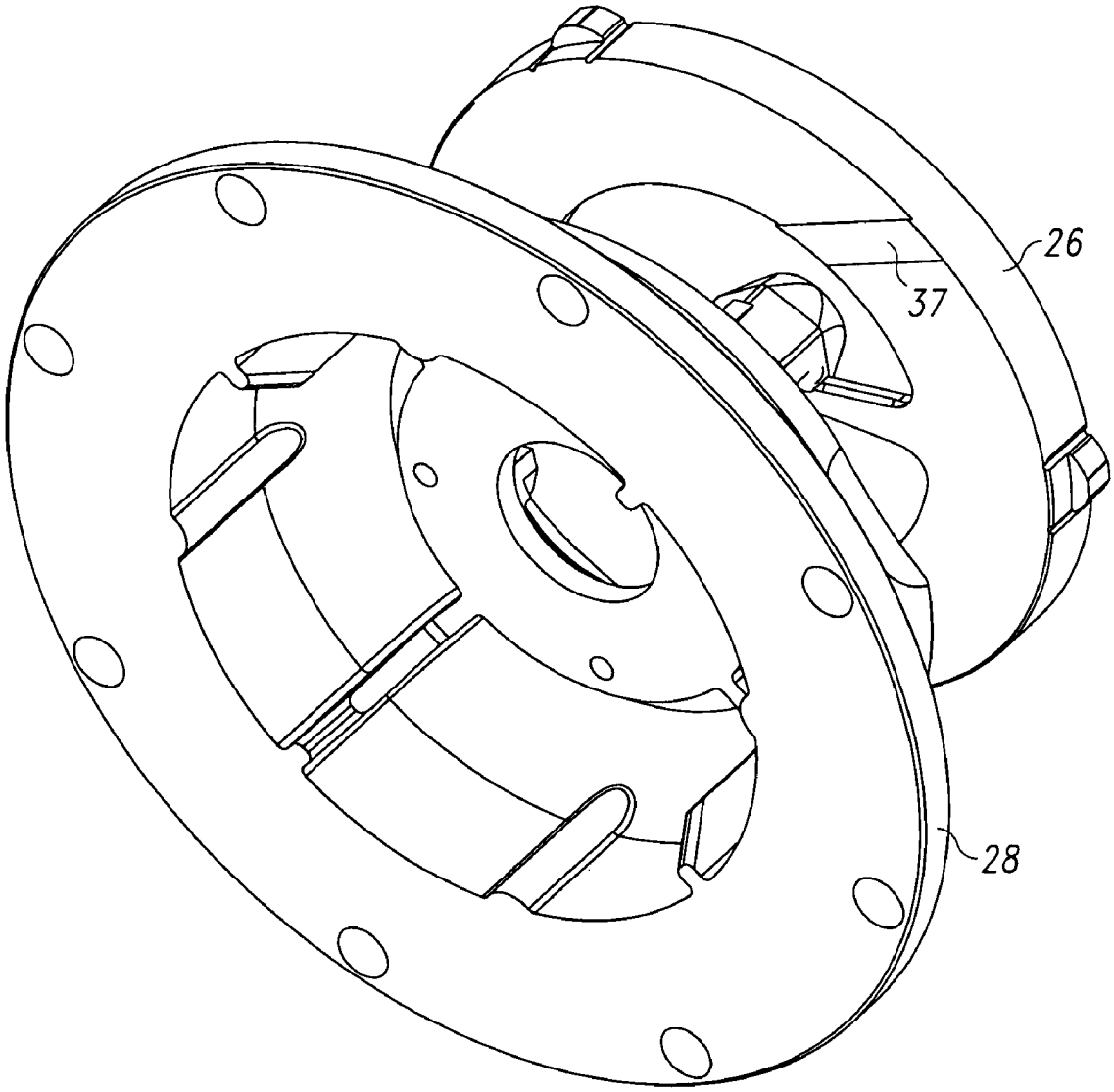
FIG. 3 is a perspective view of an internal cutter groove located on the cutter bar plate.
Figure 4:
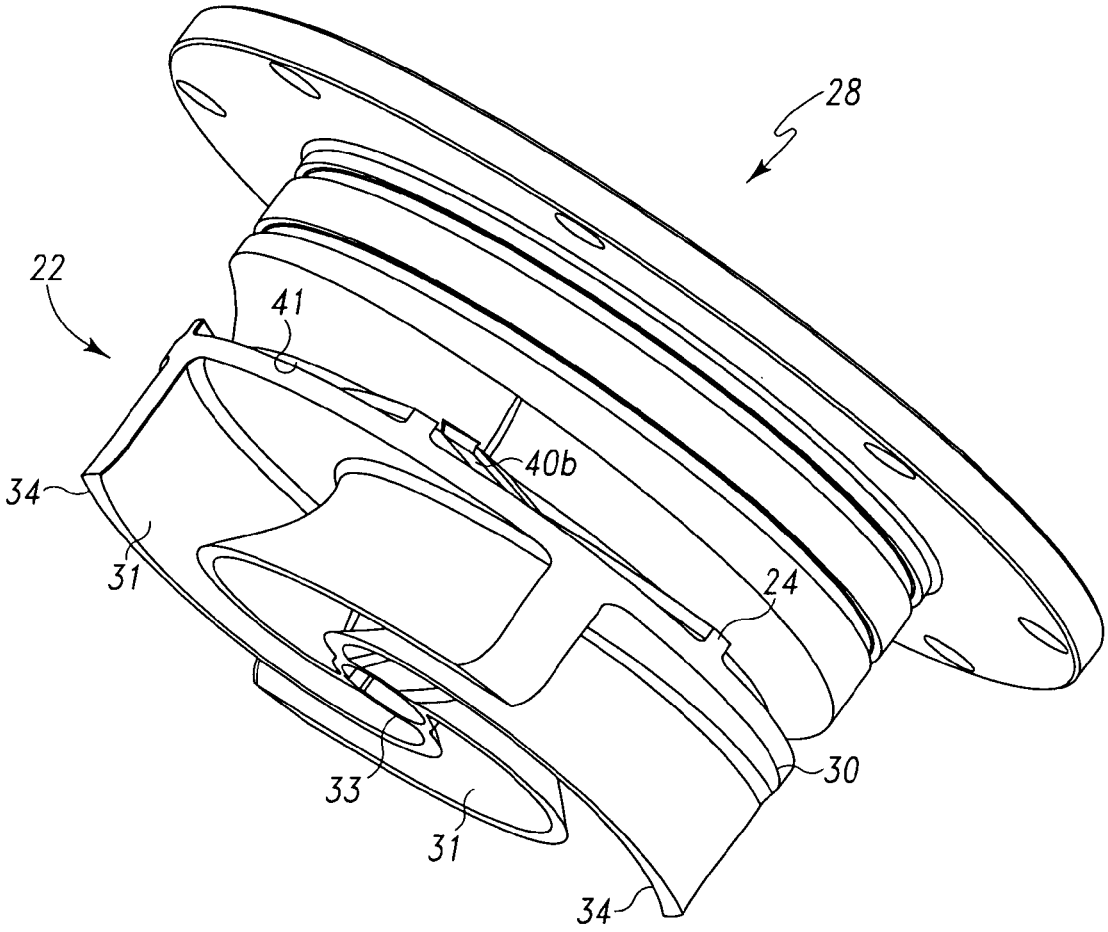
FIG. 4 is a side perspective view of an impeller and back plate in accordance with an embodiment of the present invention.
Figure 5:
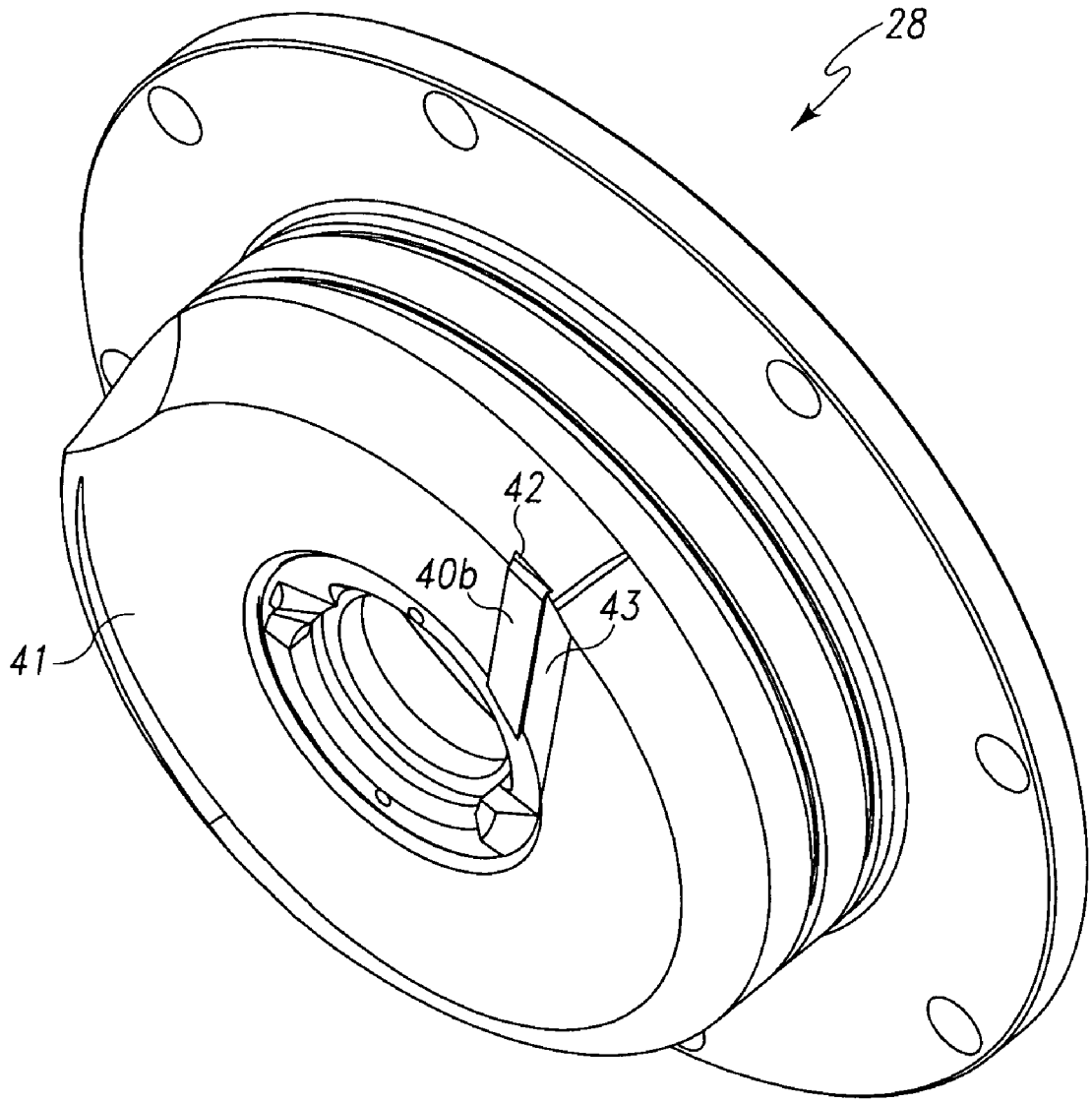
FIG. 5 is a perspective view of a back plate having a cutting rib in accordance with an embodiment of the present invention.
Figure 6:
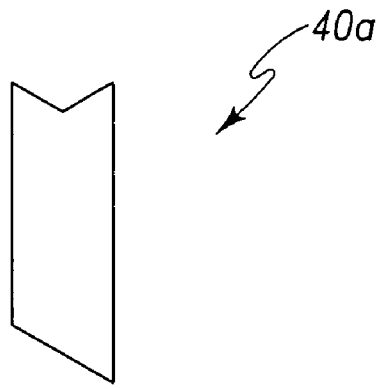
FIG. 6 is an end view of a back plate insert in accordance with an embodiment of the present invention.
Figure 7:
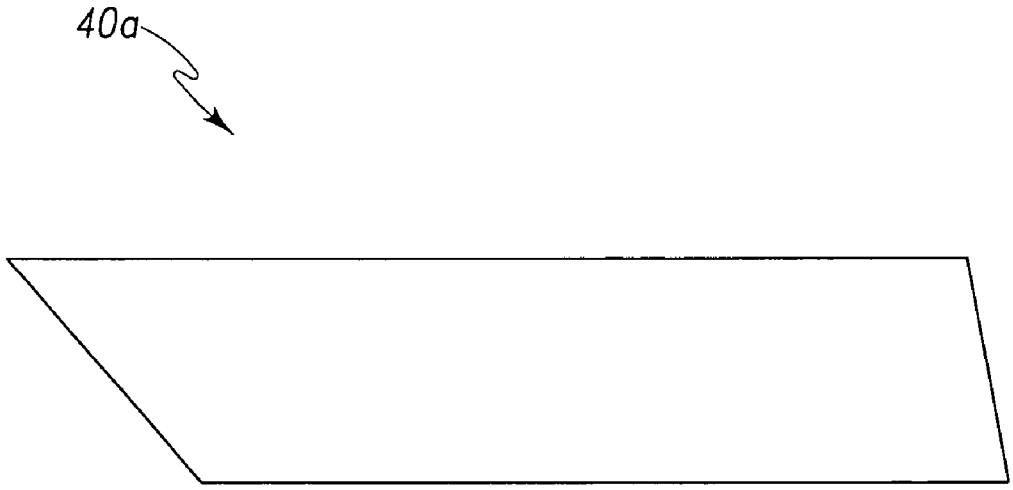
FIG. 7 is a top view of the back plate insert shown in FIG. 6.
Figure 8:
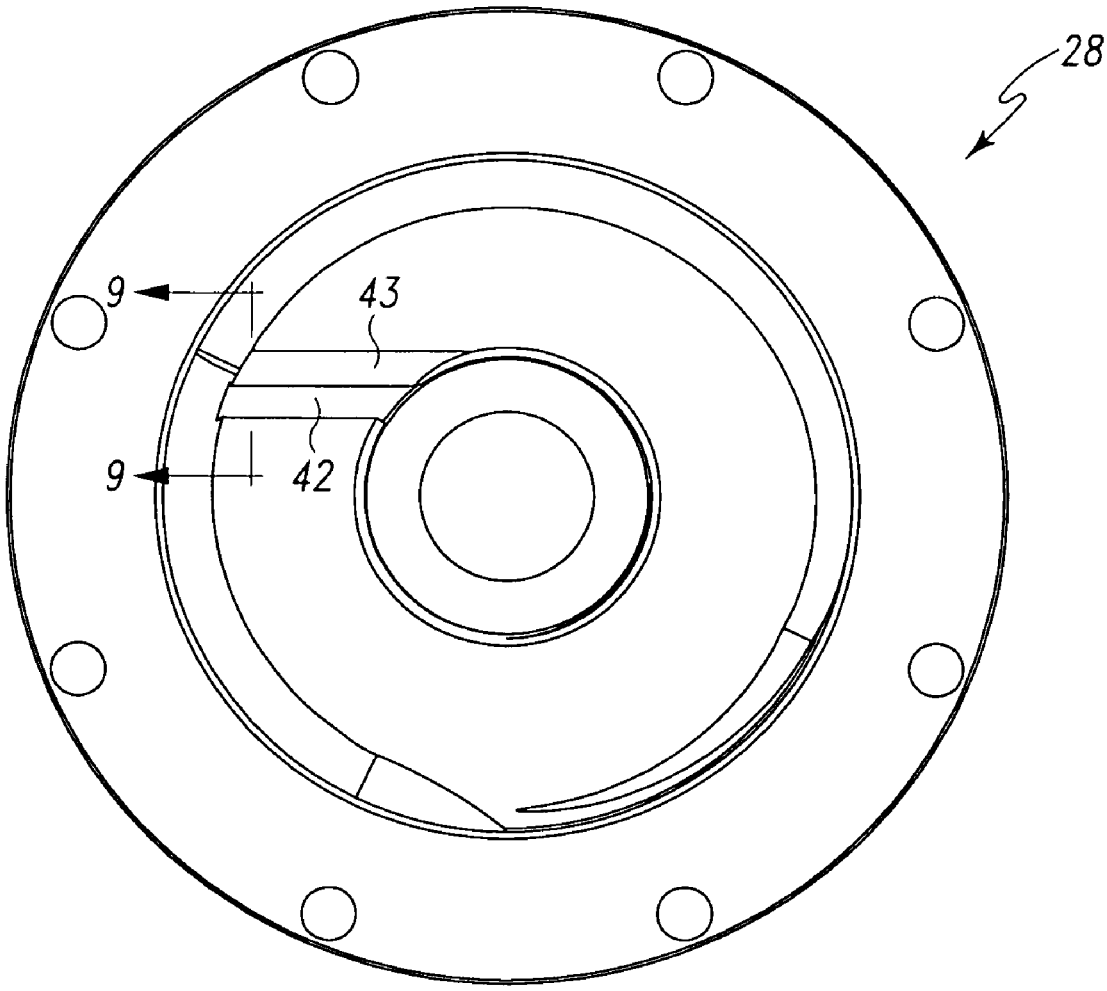
FIG. 8 is a front view of a back plate having a channel for insertion of an insert in accordance with an embodiment of the present invention.

As shown in drawing FIGS. 1, 2 and 4, positioned within the chamber 18 of the chopper pump 10 is an impeller assembly 20. Generally speaking, the impeller assembly 20 comprises an impeller 22, at least one pump-out vane 24, a cutter bar plate (also referred to as an end plate or a suction plate) 26 and a back plate 28. The impeller 22 is preferably a semi-open impeller design having a back shroud 30 onto which the blades 31 and the pump-out vanes 24 are fixed. The impeller cutting blades 31, of which four are shown but any number of blades may be possible, are radially arranged on a first surface 32 of the back shroud 30, extending outward from a central hub 33 to the surface edge. The blades 31 are preferably kept sharpened along the top edge 34 as these blades 31 are the first and primary cutting source for the chopper pump 10.

Figure 13:
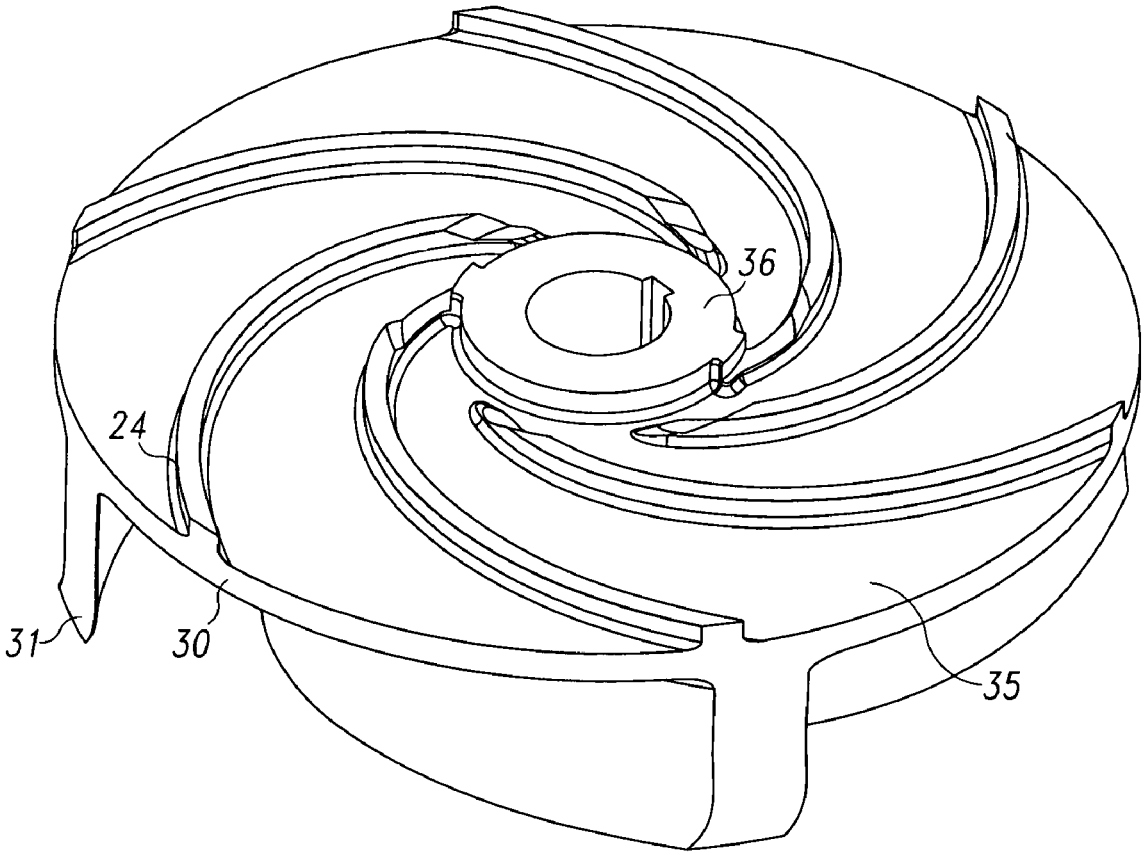
FIG. 13 is a perspective view of pump-out vanes on a surface of the back shroud of a semi-open impeller in accordance with an embodiment of the present invention.
Figure 14:
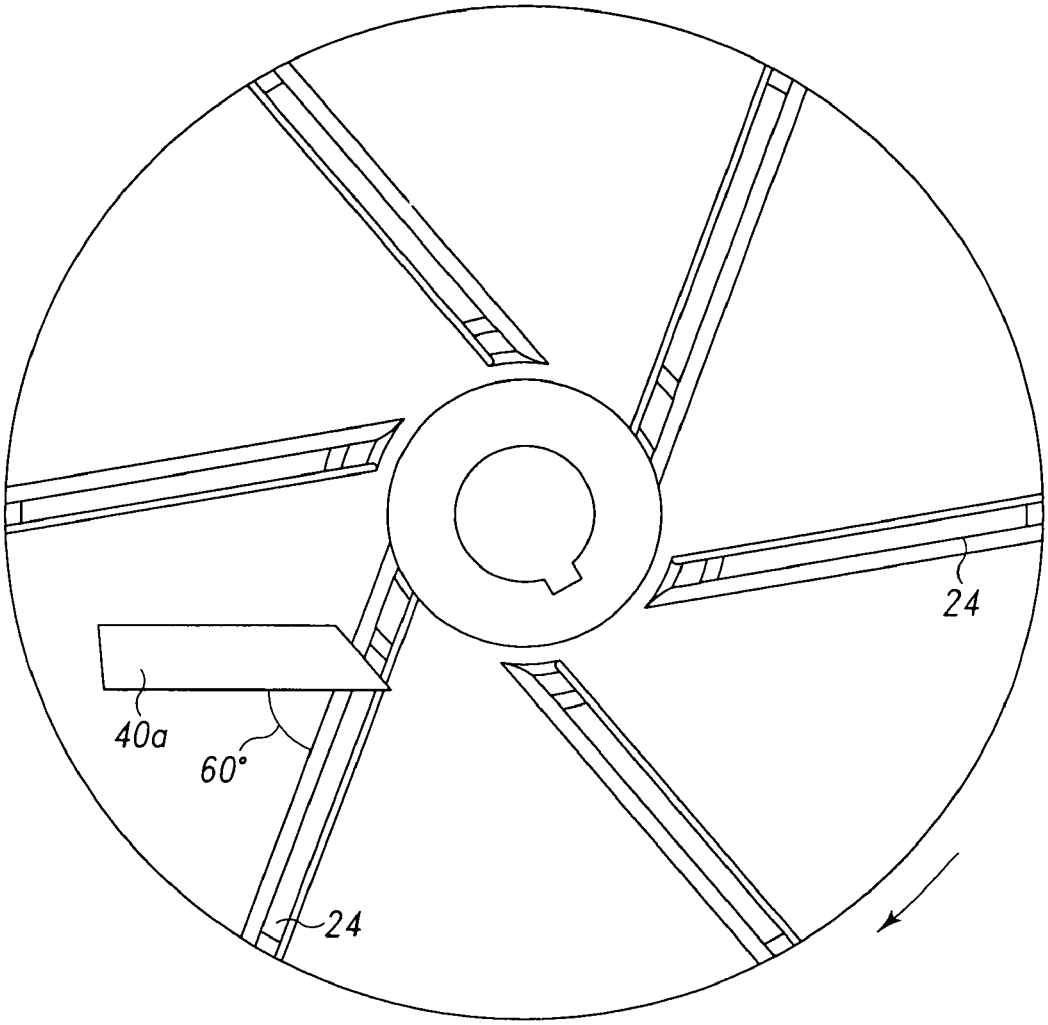
FIG. 14 is a plan view of another possible embodiment of the pump-out vanes with an imposed image of a back plate insert to illustrated cutting action in accordance with the present invention.
Figure 15:
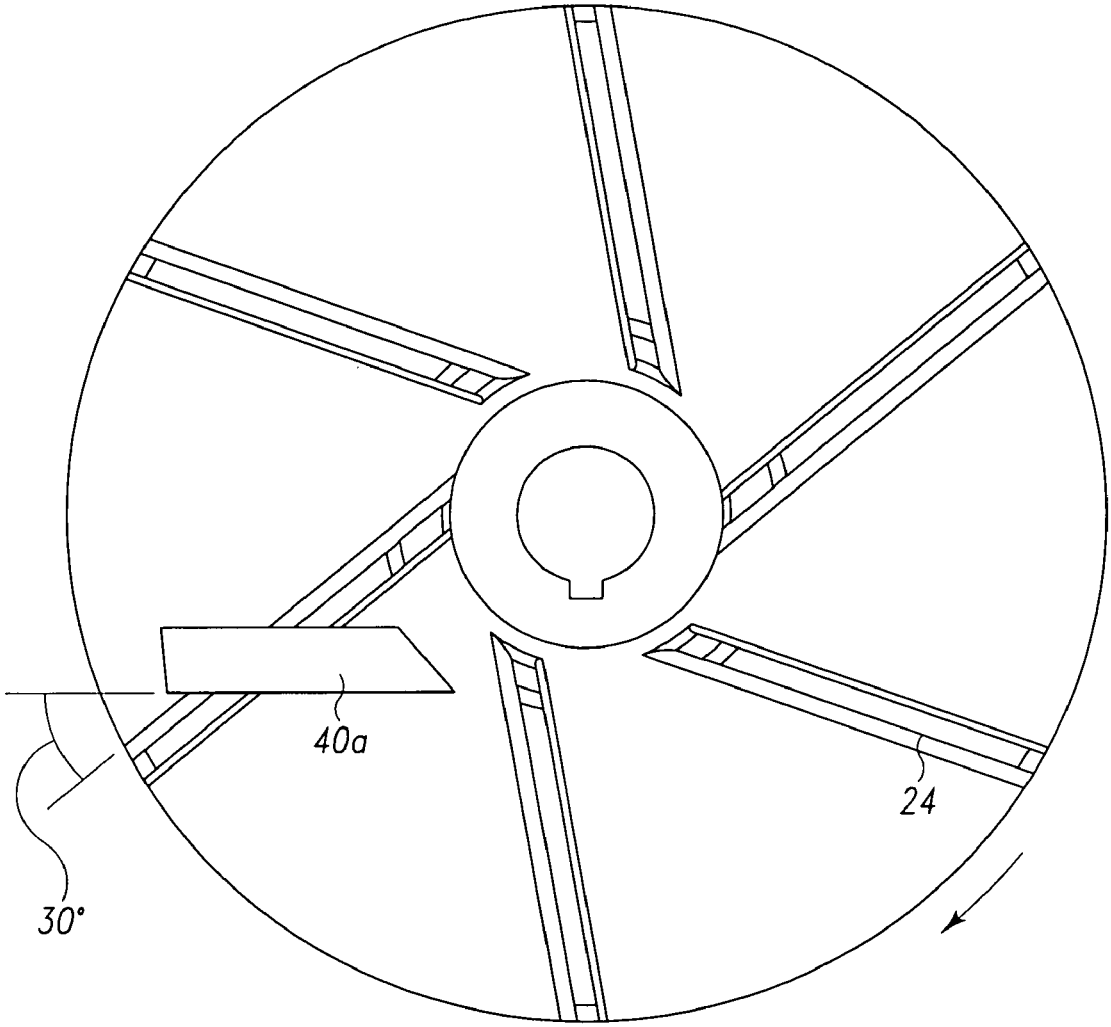
FIG. 15 is a view similar to FIG. 14 illustrating the advancement of the pump-out vanes.

The pump-out vanes 24, of which there are at least one and as many as twelve vanes (see FIG. 11), are also radially arranged and fixed on a surface of the back shroud 30 opposite the cutting blades 31, extending from a central hub 36 (FIG. 13). The pump-out vanes 24, while shown to be curved in the appended drawings, can also be straight as illustrated in FIGS. 14 and 15. The second surface 35 of the back shroud 30 anchors the pump-out vanes 24 in a position opposite the first surface 32 and facing the back plate 28.

The pump-out vanes 24 are primarily for moving material and fluid outward to be discharged from the outlet opening 16. Secondarily, the pump-out vanes 24 operate as part of another cutting zone in the chopper pump 10, as described in further detail below.

Referring to FIGS. 3-13, further components of the impeller assembly 20 can be more readily understood. At each end of the impeller 22 is a plate. A cutter bar plate 26 (a.k.a. end or suction plate) having an internal cutter groove 37 is positioned in proximity to and facing the impeller 22 at the inlet end of the chamber 18. The cutter groove 37, which is positioned radially just off-center on the cutter bar plate 26, along with the shear fingers 39 of the cutter bar plate 26 and the tooth of the cutter nut 47, operate in cooperation with the impeller blades 31 to comprise a cutting zone on the chopper pump 10. These components cooperate with the revolving impeller blades 31 to create a shearing action on any solid material in the fluid.

The use of a cutter groove 37 on the cutter bar plate 26 is an optional feature of the present invention and need not be used in all cases. The cutter groove 37 is discussed more fully in U.S. Pat. No. 7,125,221, also assigned to the Assignee of this invention, the disclosure of which is hereby incorporated by reference.

Another plate, back plate 28, is bolted at the back of the chamber 18, and includes the cutting rib 40 positioned radially, off-center on surface 41 of the plate 28 facing the pump-out vanes 24. The back plate 28, as shown in FIGS. 4, 5, 8 and 9, preferably includes a dovetail groove 42 for insertion of the back plate insert 40*a* to form cutting rib 40*b*. Naturally, the groove can be of any configuration to allow replacement of the rib. The groove 42 is cut into the surface 41 of the back plate 28 to be somewhat off-center. In some desired embodiments, the cutting rib 40*b* may be formed integral or at least permanent to the back plate 28, by machining or welding a proper insert 40*a* to the back plate. The use of an insert 40*a* allows (1) a hardened metal material to be used which is more durable than the material of the back plate, and (2) replacement of the insert when it becomes worn. The off-center positioning allows for a better cutting action between the cutting rib 40 and the pump out vanes 24 as well as a better flushing path for the cut material. Also, as will be explained below, the off-center rib permits the rotating pump-out vanes 24 to cross the rib 40 at an effective shearing angle.

It is believed that only a single cutting rib 40 is required with most applications. However, in some instances it may be desirable or necessary to use two back cutting ribs. Such additional ribs may be positioned in consecutive or alternate quadrants from one another on the surface 41 of the back plate 28.

Figure 9:
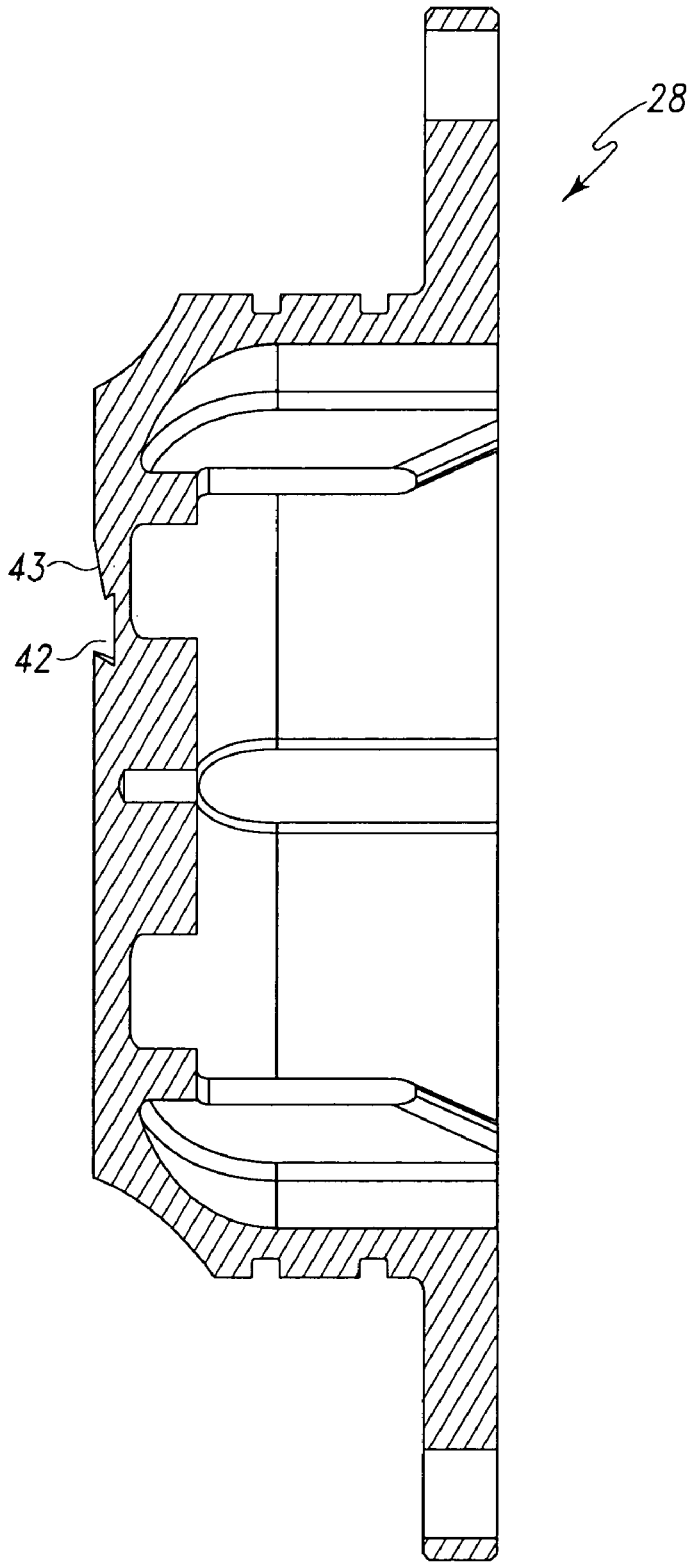
FIG. 9 is a cross-section taken along lines 9-9 of FIG. 8.
Figure 10:
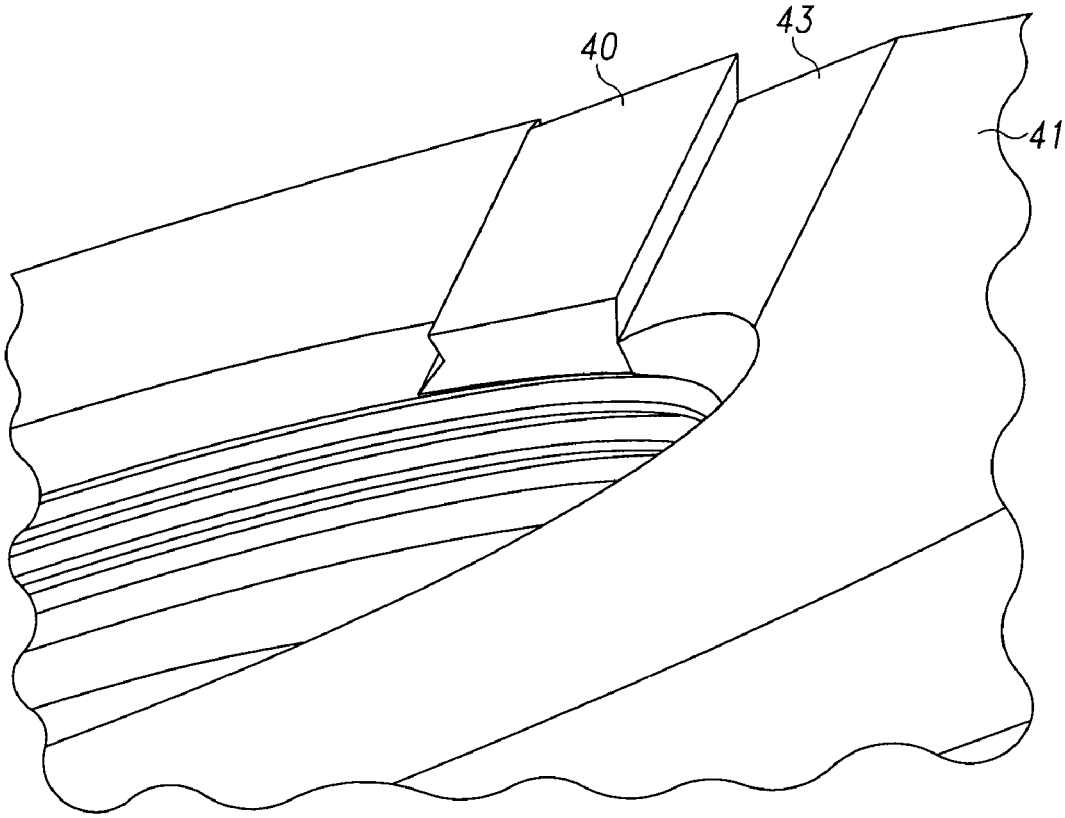
FIG. 10 a close-up view of a cutting rib in accordance with an embodiment of the present invention.
Figure 11:
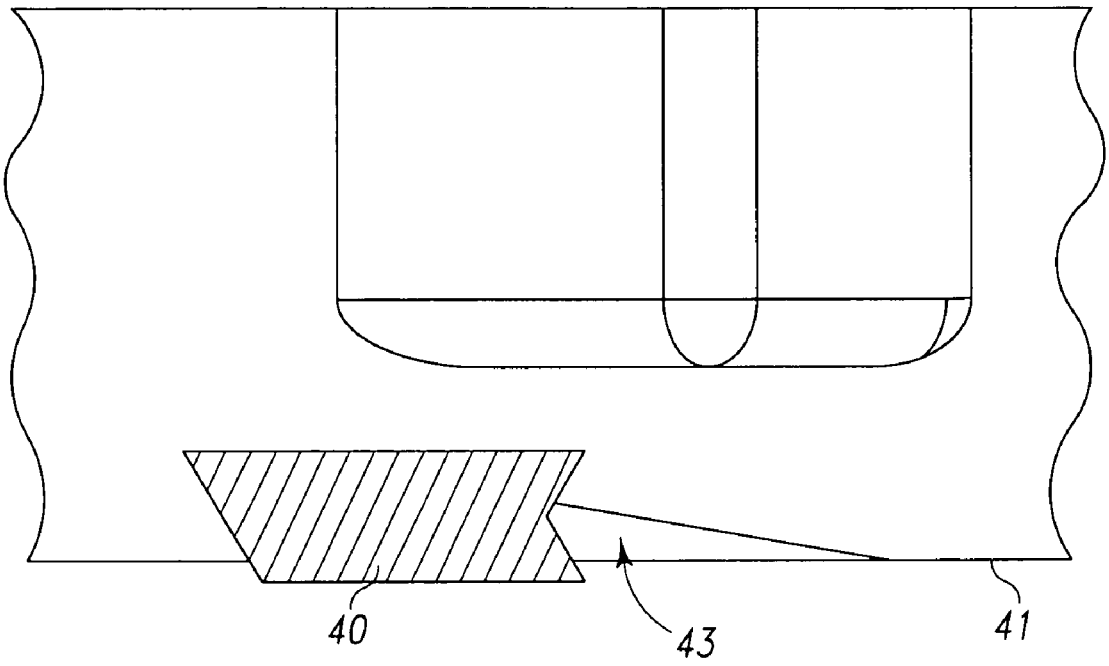
FIG. 11 is a side view of the cutting rib illustrated in FIG. 10.
Figure 12:
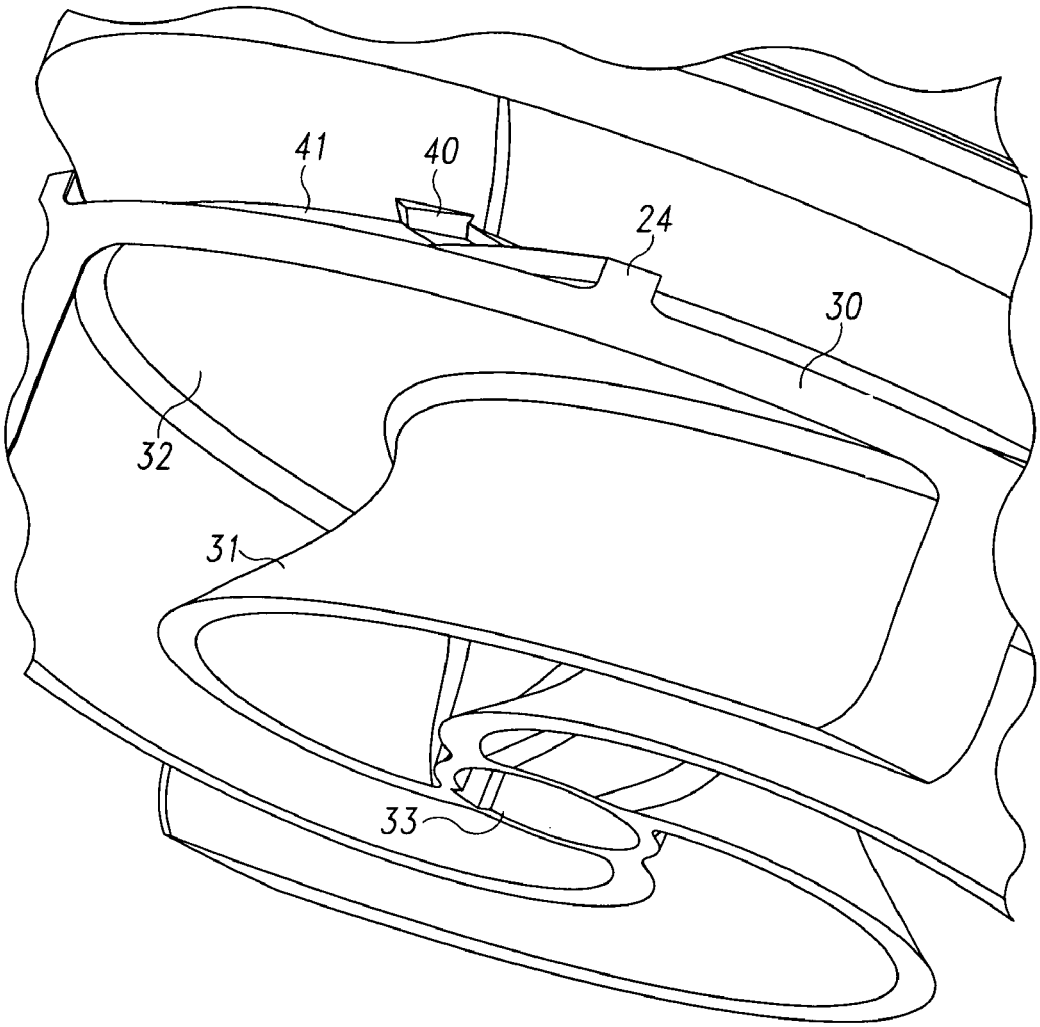
FIG. 12 is a partial close-up view of the impeller and back plate showing a cutting zone between a cutting rib and a pump-out vane.

A recessed area 43, shown best in FIGS. 9 and 10, precedes the groove 42 in the surface 41 of the back plate 28. The recessed area 43 helps to expose more of the back cutting rib 40 during the shearing action.

In the present embodiment, the cutting rib 40 shown in FIGS. 4-7 is preferably made of one of either a hardened steel or hardened stainless steel. As a hardened steel, the final insert 40*a* preferably has a hardness measure of at least HRC 60, and as a hardened stainless steel a measure of about HRC 40. Such hardness gives the cutting rib 40*b* the necessary durability to operate effectively and efficiently before needing replacement.

As stated above, the insert 40*a* fits tightly within a groove 42 machined into the surface 41 of the back plate 28. In addition to this friction fit within the preferably dovetailed groove 42, the cutting rib 40 should be held in place using a high-strength adhesive and retained mechanically by obstructions placed at each end of the groove 42. As the cutting rib 40 becomes worn, it can be removed and readily replaced.

In addition to the recessed area 43 described above, the back cutting rib 40 is also made to be positioned such that it is raised above the back plate surface 41. A gap created between the back cutting rib 40 and the pump-out vanes 24 is preferably within the range of from about 0.005 to about 0.025 inches (0.0127 to 0.063 cm), and most preferably in the range of from about 0.010 to 0.020 inches (0.0254 to 0.0508 cm). The gap is very important to the efficient operation of the cutting rib 40. If the gap is too large, the drive motor power required may be excessive, resulting in motor overload tripping. If the gap is too narrow, metal-to-metal contact problems may result during pump operation.

Looking now at FIGS. 12-15, the pump-out vanes 24 of the impeller assembly 20 can be more readily seen. The pump-out vanes 24, of which there are preferably four, have three purposes: (1) to reduce the presence of solids in the mechanical seal cavity area of the pump and thereby improve seal life; (2) to help balance axial thrust on the impeller to improve thrust bearing life; and (3) to reduce pressure in the mechanical seal cavity to prevent contamination of the mechanical seal. However, in prior art systems these vanes 24 tend to collect solid waste.

The vanes 24 are fixed to the back surface 35 of the back shroud 30. In embodiments where the vanes are contoured to the circular motion of the impeller 22, i.e., the vanes 24 are curved, the cutting angle is consistently within the range of 60 to 90 degrees for the length of the cut. However, as shown in FIGS. 14 and 15, where the vanes 24 are straight or far less curved, the cutting angle is initially 60 to 90 degrees and becomes more steep/acute, less than about 20 degrees created between a leading edge of the vanes 24 and the off-center cutting rib 40 within the cutting zone. In either case, the rotating vanes 24 act as sharpened hammers against the anvil-like cutting rib 40 to cut material. Naturally, the cutting angle can be adjusted to operate within most any given range by properly configuring the curve of pump-out vanes 24 in relation to the back cutting rib 40.

In operation, liquids or slurries including solid waste material (collectively "fluid") enter the chopper pump 10 at the inlet opening 14 as a result of the suction created by the impeller 22 motion turned by motor 50. While the present system may be employed for most any chopper pump operations, it is particularly useful for small electric motor systems. By "small motors" it is meant to include such motors rated under 30 horsepower (hp), especially those in the 5 to 10 hp range. The reason for particular application to these motors relates to the overload tendency of such motors due to the additional torque required to overcome the binding caused by solid waste gathering between the rotating pump-out vanes 24 and the stationary back plate 28 as previously mentioned. The disclosed invention is certainly suitable for motors of greater than 30 hp, including large pumps in the 60 to 200 hp range, but such motors are less affected by power increases and are, therefore, less susceptible to going offline due to such an increase.

The fluid enters the chamber 18 at the first or primary cutting zone where the fluid is subjected to a first shearing action between the impeller blades 31 and the components of the cutter bar plate 26, including the internal cutter groove 37, the shear fingers 39 and also the tooth of the cutter nut 47, which cuts against the ends of the shear fingers 39. From there, most fluid travels from the chamber 18 to the outlet port opening 16. Some of the fluid ends up at the second cutting zone where it goes through another shearing action between the pump-out vanes 24 and the cutting rib 40 and also between the rotating impeller hub and the upper cutting ring. These components should be carefully gapped to provide the most efficient and effective cutting of difficult material—i.e., material which is not readily broken, but must be cut with scissor like action. Eventually, the fluid in the second cutting zone is also delivered to the outlet port opening 16 for discharge.

While the present invention is exclusively described herein for use on a chopper pump, the inventors concede that it may have practical uses on other types of pumps as well. For example, a raised cutting rib may be used on a screw-centrifugal pump-currently sold as TRITON® pumps by Vaughan—or on vortex (i.e., recessed impeller) pumps to pump relatively "clean" sludge in a system. By "clean" it is meant that the sludge has no large debris to be chopped by the pump. Such sludge is still replete with fine fibers, such as hair, strands of fabric and the like. The use of a cutting rib exclusively for such pump systems would be useful.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of applicants' contribution. The actual scope of the protection sought is intended to be defined in the following claims when viewed in their proper perspective based on the prior art.

What is claimed is:

1. An impeller assembly for a chopper pump comprising:

an impeller having a back shroud and cutting blades sharpened on a first edge, the cutting blades extending from and fixed on a first surface of the back shroud;

at least one pump-out vane fixed to a second surface of the back shroud, the second surface being opposite the first surface;

an end plate having a surface adjacent to and facing the first edge of the cutting blades and having at least one shearing finger integral to the end plate for shearing operation in combination with the sharpened edge of the cutting blades of the impeller; and a back plate having a surface adjacent to and facing the at least one pump-out vane and at least one cutting rib attached to the back plate surface for shearing operation in combination with the at least one pump-out vane.

2. The assembly of claim 1, wherein the at least one cutting rib is aligned radially on the surface of the back plate.

3. The assembly of claim 1, wherein a gap between the at least one cutting rib and the at least one pump-out vane is in the range of from about 0.005 to 0.025 inches.

4. The assembly of claim 3, wherein the gap is in the range of from about 0.010 to about 0.020 inches.

5. The assembly of claim 2, wherein the at least one cutting rib is raised above the surface of the back plate.

6. The assembly of claim 1, wherein the surface of the back plate comprises a recessed area and a single cutting rib is attached within the recess.

7. The assembly of claim 1, wherein the cutting rib is comprised of one of either hardened stainless steel or hardened steel.

8. The assembly of claim 7, wherein the cutting rib is comprised of hardened steel having a hardness measure of at least HRC 60.

9. The assembly of claim 7, wherein the cutting rib is comprised of hardened stainless steel having a hardness measure of about HRC 40.

10. The assembly of claim 1, wherein the at least one cutting rib is detachable from the surface to allow replacement of the cutting rib.

11. The assembly of claim 1, wherein the impeller is a semi-open impeller.

12. The assembly of claim 1, comprising a single cutting rib.

13. The assembly of claim 5, wherein the cutting rib is raised above the surface of the back plate to cut against the at least one pump-out vane.

14. A chopper pump comprising:

a housing having an intake opening and an outlet opening, both in fluid communication with an internal chamber; and an impeller assembly positioned within the chamber and comprising:

cutting blades sharpened on a first edge fixed to and extending from a first surface of an impeller back shroud;

at least one pump-out vane fixed to and extending from a second surface of the back shroud opposite the first surface;

a cutter bar plate having a surface adjacent to and facing the first edge of the cutting blades and at least one of either a shearing finger and an internal cutting bar fixed to the cutter bar plate for cooperating with the cutting blades to define a first zone; and a back plate having a surface adjacent to and facing the at least one pump-out vane and at least one cutting rib attached to the back plate surface, the at least one cutting rib and the at least one pump-out vane cooperating to define a second zone;

wherein material entering the intake opening of the housing passes into the chamber where it is subject to shearing action in at least one of either the first zone and the second zone before being discharged through the outlet opening.

15. The chopper pump of claim 14, wherein the at least one cutting rib is aligned radially on the surface of the back plate and the at least one pump-out vane is substantially transverse to the cutting rib in the first zone.

16. The chopper pump of claim 14, wherein the surface of the back plate comprises a recessed area and a single cutting rib is attached within the recess.

17. The chopper pump of claim 14, wherein the cutting rib is comprised of one of either hardened stainless steel or hardened steel.

18. The chopper pump of claim 17, wherein the cutting rib is comprised of hardened steel having a hardness measure of at least HRC 60.

19. The chopper pump of claim 17, wherein the cutting rib is comprised of hardened stainless steel having a hardness measure of about HRC 40.

20. The chopper pump of claim 14, wherein the at least one cutting rib is detachable from the surface to allow replacement of the cutting rib.

21. The chopper pump of claim 14, wherein the impeller is a semi-open impeller.

22. The chopper pump of claim 14, comprising a single cutting rib.

23. The chopper pump of claim 15, wherein the cutting rib is raised above the surface of the back plate to cut against the at least one pump-out vane.

24. The chopper pump of claim 14, wherein a gap between the at least one cutting rib and the at least one pump-out vane in the second zone is in the range of from about 0.005 to 0.025 inches.

25. The chopper pump of claim 24, wherein the gap is in the range of from about 0.010 to about 0.020 inches.

26. A cutting assembly for a fluid pump comprising:

at least one pump-out vane fixed to a rotating surface of the pump and operating to direct a fluid from within a pump chamber to an outlet; and a stationary plate having a surface adjacent to and facing the at least one pump-out vane and having at least one cutting rib attached to the stationary plate surface;

wherein the cutting rib and the pump-out vanes are spaced a distance apart to perform a shearing operation on solid material within the fluid.

27. The assembly of claim 26, wherein the pump is selected from the group consisting of a chopper pump, a screw-centrifugal pump, and a vortex (recessed impeller) pump.

28. The assembly of claim 26, wherein the distance between the at least one cutting rib and the at least one pump-out vane is in the range of from about 0.005 to 0.025 inches.

29. The assembly of claim 28, wherein the gap is in the range of from about 0.010 to about 0.020 inches.

30. The assembly of claim 26, wherein the at least one cutting rib is raised above the surface of the stationary plate.

31. The assembly of claim 26, wherein the surface of the stationary plate comprises a recessed area and a single cutting rib is attached within the recess.

32. The assembly of claim 26, wherein the at least one cutting rib is detachable from the surface to allow replacement of the cutting rib.

* * * * *